US012338688B2

(12) United States Patent
Alghanmi et al.

(10) Patent No.: US 12,338,688 B2
(45) Date of Patent: Jun. 24, 2025

(54) INTELLIGENT MEASURING WHILE DRILLING

(71) Applicant: SAUDI ARABIAN OIL COMPANY, Dhahran (SA)

(72) Inventors: Abdulmalik Abdullah Alghanmi, Al Ghazawat (SA); Abdulaziz S. Al-Qasim, Dammam (SA); Bodong Li, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 226 days.

(21) Appl. No.: 18/176,225

(22) Filed: Feb. 28, 2023

(65) Prior Publication Data

US 2024/0287856 A1 Aug. 29, 2024

(51) Int. Cl.

| | |
|---|---|
| ***E21B 17/02*** | (2006.01) |
| ***E21B 17/00*** | (2006.01) |
| ***E21B 47/135*** | (2012.01) |

(52) U.S. Cl.

CPC ..... *E21B 17/028* (2013.01); *E21B 17/003* (2013.01); *E21B 47/135* (2020.05)

(58) Field of Classification Search

CPC ..... E21B 17/003; E21B 17/028; F16L 25/01; H01R 13/533; H01R 13/625

See application file for complete search history.

(56) References Cited

U.S. PATENT DOCUMENTS

| | | | | |
|---|---|---|---|---|
| 2,197,392 | A * | 4/1940 | Hawthorn | E21B 17/003 439/194 |
| 2,973,996 | A | 3/1961 | Self | |
| 3,253,245 | A | 5/1966 | Brandt | |
| 4,799,544 | A * | 1/1989 | Curlett | E21B 21/08 439/191 |
| 5,517,024 | A | 5/1996 | Mullins et al. | |
| 6,123,561 | A * | 9/2000 | Turner | E21B 17/028 439/194 |
| 6,670,880 | B1 * | 12/2003 | Hall | E21B 17/0283 336/15 |

(Continued)

OTHER PUBLICATIONS

International Search Report and Written Opinion issued in Application No. PCT/US2024/017305, mailed on Jun. 4, 2024 (14 pages).

*Primary Examiner* — Jennifer H Gay

(74) *Attorney, Agent, or Firm* — Osha Bergman Watanabe & Burton LLP

(57) ABSTRACT

A wellbore tubular including a pre-installed data transmission cable is disclosed. The tubular includes a hollow cylinder, a stationary ring disposed at the lower end of the cylindrical wall and having a lower end hollow pin protruding downward from the stationary ring, a rotating ring disposed at the upper end of the cylindrical wall and having an upper end hollow pin protruding upward from the rotating ring, a rigid conduit disposed inside the hollow cylinder and extending from the lower end hollow pin to beneath the rotating ring, a elastic conduit disposed inside the hollow cylinder to extend the rigid conduit from beneath the rotating ring to the upper end hollow pin, and a data transmission cable routed from the lower end hollow pin to the upper end hollow pin through the rigid conduit and the elastic conduit.

20 Claims, 8 Drawing Sheets

(56) References Cited

U.S. PATENT DOCUMENTS

| | | | | |
|---|---|---|---|---|
| 6,717,501 | B2 * | 4/2004 | Hall | H01R 13/533 336/15 |
| 6,942,043 | B2 | 9/2005 | Kurkoski | |
| 8,342,865 | B2 * | 1/2013 | Scheibelmasser | H01R 39/18 439/191 |
| 8,517,749 | B2 * | 8/2013 | Marshall | F16L 39/005 62/50.7 |
| 8,950,787 | B2 * | 2/2015 | Chabas | E21B 17/0283 340/854.7 |
| 9,267,337 | B2 * | 2/2016 | Alaria | E21B 17/028 |
| 9,322,223 | B2 | 4/2016 | Johnson et al. | |
| 9,534,455 | B2 * | 1/2017 | Peters | E21B 17/042 |
| 12,116,847 | B2 * | 10/2024 | Steele | E21B 17/025 |
| 2002/0075114 | A1 * | 6/2002 | Hall | E21B 17/003 336/192 |
| 2009/0123221 | A1 * | 5/2009 | Marshall | F16L 39/005 403/24 |
| 2011/0217861 | A1 * | 9/2011 | Scheibelmasser | H01R 13/622 439/271 |
| 2012/0012301 | A1 * | 1/2012 | Hughes | H01R 13/533 439/190 |
| 2013/0186669 | A1 * | 7/2013 | Chabas | E21B 17/028 174/47 |
| 2014/0349505 | A1 * | 11/2014 | Alaria | H01R 13/533 439/314 |
| 2017/0227145 | A1 | 8/2017 | Green et al. | |
| 2022/0333445 | A1 * | 10/2022 | Steele | E21B 17/05 |
| 2022/0333463 | A1 * | 10/2022 | Steele | E21B 17/05 |
| 2024/0287856 | A1 * | 8/2024 | Alghanmi | E21B 17/028 |

* cited by examiner

INTELLIGENT MEASURING WHILE DRILLING

BACKGROUND

Measuring-While-Drilling (or MWD) is a type of well logging that incorporates the measurement tools into the drill string and provides real-time information to facilitate steering the drill bit. MWD is a type of Logging-While-Drilling (LWD) where tools are encompassed in a module of the drill string or the bottom hole assembly. For example, MWD may use gyroscopes, magnetometers, accelerometers, and other types of sensors to determine borehole inclination and azimuth, drill bit information and directional data, as well as other real-time drilling information during the actual drilling.

Fiber optics refers to the technology that transmits information as light pulses along a glass or plastic fiber. Fiber optics is used for long-distance and high-performance data networking. An optical fiber is a strand of flexible and transparent fiber made by drawing glass (silica) or plastic to a diameter slightly thicker than that of a human hair. A fiber optics cable or optical fiber cable can contain a varying number of optical fibers, from a few up to a few hundreds. A glass layer, called cladding, surrounds the glass fiber core. A buffer tube layer protects the cladding, and a jacket layer acts as the final protective layer for the individual strand. Throughout this disclosure, depending on the context, the term "optical fiber cable" refers to either a single strand of optical fiber or a cable including multiple optical fibers.

SUMMARY

In general, in one aspect, the invention relates to a wellbore tubular for performing a wellbore operation in a subterranean formation. The wellbore tubular includes a hollow cylinder formed by a cylindrical wall having a male thread fitting and a female thread fitting at a lower end and an upper end, respectively, of the cylindrical wall, a first stationary ring disposed at the lower end of the cylindrical wall and having a first lower end hollow pin protruding downward from the first stationary ring, a first rotating ring disposed at the upper end of the cylindrical wall and having a first upper end hollow pin protruding upward from the first rotating ring, a first rigid conduit disposed inside the hollow cylinder and extending from the first lower end hollow pin to beneath the first rotating ring, a first elastic conduit disposed inside the hollow cylinder to extend the first rigid conduit from beneath the first rotating ring to the first upper end hollow pin, and a first data transmission cable routed from the first lower end hollow pin to the first upper end hollow pin through the first rigid conduit and the first elastic conduit, wherein the wellbore tubular is adapted to connect to a lower wellbore tubular using the male thread fitting to collectively form a portion of a wellbore string, wherein the first lower end hollow pin is adapted to connect with a second upper end hollow pin of the lower wellbore tubular prior to a first rotating threading motion of the wellbore tubular to connect to the lower wellbore tubular, wherein the first stationary ring is adapted to connect and rotate with a second rotating ring of the lower wellbore tubular during the first rotating threading motion of the wellbore tubular, and wherein connecting the second upper end hollow pin of the lower wellbore tubular and the first lower end hollow pin allows the first rigid conduit and the first elastic conduit to connect to a second rigid conduit and a second elastic conduit inside the lower wellbore tubular to form a portion of a contiguous data transmission cable conduit from a downhole location to the Earth's surface.

In general, in one aspect, the invention relates to a wellbore string for drilling a subterranean formation. The wellbore string includes a wellbore tubular comprising a hollow cylinder formed by a cylindrical wall having a male thread fitting and a female thread fitting at a lower end and an upper end, respectively, of the cylindrical wall, a first stationary ring disposed at the lower end of the cylindrical wall and having a first lower end hollow pin protruding downward from the first stationary ring, a first rotating ring disposed at the upper end of the cylindrical wall and having a first upper end hollow pin protruding upward from the first rotating ring, a first rigid conduit disposed inside the hollow cylinder and extending from the first lower end hollow pin to beneath the first rotating ring, a first elastic conduit disposed inside the hollow cylinder to extend the first rigid conduit from beneath the first rotating ring to the first upper end hollow pin, and a first data transmission cable routed from the first lower end hollow pin to the first upper end hollow pin through the first rigid conduit and the first elastic conduit, and a lower wellbore tubular, wherein the wellbore tubular is adapted to connect to the lower wellbore tubular using the male thread fitting to collectively form a portion of the wellbore string, wherein the first lower end hollow pin is adapted to connect with a second upper end hollow pin of the lower wellbore tubular prior to a first rotating threading motion of the wellbore tubular to connect to the lower wellbore tubular, wherein the first stationary ring is adapted to connect and rotate with a second rotating ring of the lower wellbore tubular during the first rotating threading motion of the wellbore tubular, and wherein connecting the second upper end hollow pin of the lower wellbore tubular and the first lower end hollow pin allows the first rigid conduit and the first elastic conduit to connect to a second rigid conduit and a second elastic conduit inside the lower wellbore tubular to form a portion of a contiguous data transmission cable conduit from a downhole location to the Earth's surface.

In general, in one aspect, the invention relates to a method for performing a wellbore operation at a wellsite of a subterranean formation. The method includes obtaining a wellbore tubular at the wellsite, the wellbore tubular comprising a hollow cylinder formed by a cylindrical wall having a male thread fitting and a female thread fitting at a lower end and an upper end, respectively, of the cylindrical wall, a first stationary ring disposed at the lower end of the cylindrical wall and having a first lower end hollow pin protruding downward from the first stationary ring, the first stationary ring comprising a first rotatable inner ring, the first rotatable inner ring comprising a first hollow interior space adapted to store a first extra length of a first data transmission cable, a first rotating ring disposed at the upper end of the cylindrical wall and having a first upper end hollow pin protruding upward from the first rotating ring, a first rigid conduit disposed inside the hollow cylinder and extending from the first lower end hollow pin to beneath the first rotating ring, a first elastic conduit disposed inside the hollow cylinder to extend the first rigid conduit from beneath the first rotating ring to the first upper end hollow pin, and the first data transmission cable routed from the first lower end hollow pin to the first upper end hollow pin through the first rigid conduit and the first elastic conduit, wherein the wellbore tubular is adapted to connect, using the male thread fitting, to a lower wellbore tubular at a top end of a wellbore string to extend the wellbore string, wherein the first lower end hollow pin is adapted to connect with a second upper end hollow pin of the lower wellbore tubular prior to a first rotating threading motion of the wellbore tubular to connect to the lower wellbore tubular, wherein the first stationary ring is adapted to connect and rotate with a second rotating ring of the lower wellbore tubular during the first rotating threading motion of the wellbore tubular, wherein connecting the second upper end hollow pin of the lower wellbore tubular and the first lower end hollow pin allows the first rigid conduit and the first elastic conduit to connect to a second rigid conduit and a second elastic conduit inside the lower wellbore tubular to form a portion of a contiguous data transmission cable conduit from a downhole location to the Earth's surface, and wherein connecting the second upper end hollow pin of the lower wellbore tubular and the first lower end hollow pin further allows the first data transmission cable to connect to a second data transmission cable routed through the second rigid conduit and the second elastic conduit inside the lower wellbore tubular to form a portion of a contiguous data transmission cable from the downhole location to the Earth's surface, disconnecting, from a patch panel at the wellsite, an upper terminal of the second data transmission cable at a top end of the wellbore string, retrieving, from the wellbore tubular through the first lower end hollow pin, a lower terminal of the first data transmission cable, connecting, using a connecting device, the lower terminal of the first data transmission cable and the upper terminal of the second data transmission cable to form the portion of the contiguous data transmission cable, releasing, from the connecting device, the first data transmission cable and the second data transmission cable to stow the first extra length of the first data transmission cable into at least the first rotatable inner ring, inserting the first lower end hollow pin of the first stationary ring and the second upper end hollow pin of the second rotating ring into each other to form the portion of the contiguous data transmission cable conduit, joining, by the first rotating threading motion of the wellbore tubular, the wellbore tubular and the lower wellbore tubular together at the top end of the wellbore string to extend the wellbore string, and reconnecting, through the first upper end hollow pin of the wellbore tubular, an upper terminal of the first data transmission cable to the patch panel to facilitate performing the wellbore operation.

Other aspects and advantages will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments of this disclosure provide a method for transmitting data between a downhole location (e.g., the drilling bit) and the Earth's surface in real-time to facilitate measurement and analysis of wellbore operations, such as drilling operations, production operations, or other reservoir exploration operations. In one or more embodiments of the invention, fiber optics are used to establish fast, secure, and safe communication as facilitated by a mechanism for connecting the optical fiber cables with each insertion of wellbore tubular during the wellbore operation (e.g., insertion of drill pipe during the drilling process). Further, a communication link is established via one single optical fiber without inserting a fiber optic connector several times during the drilling process.

Figure 1A:
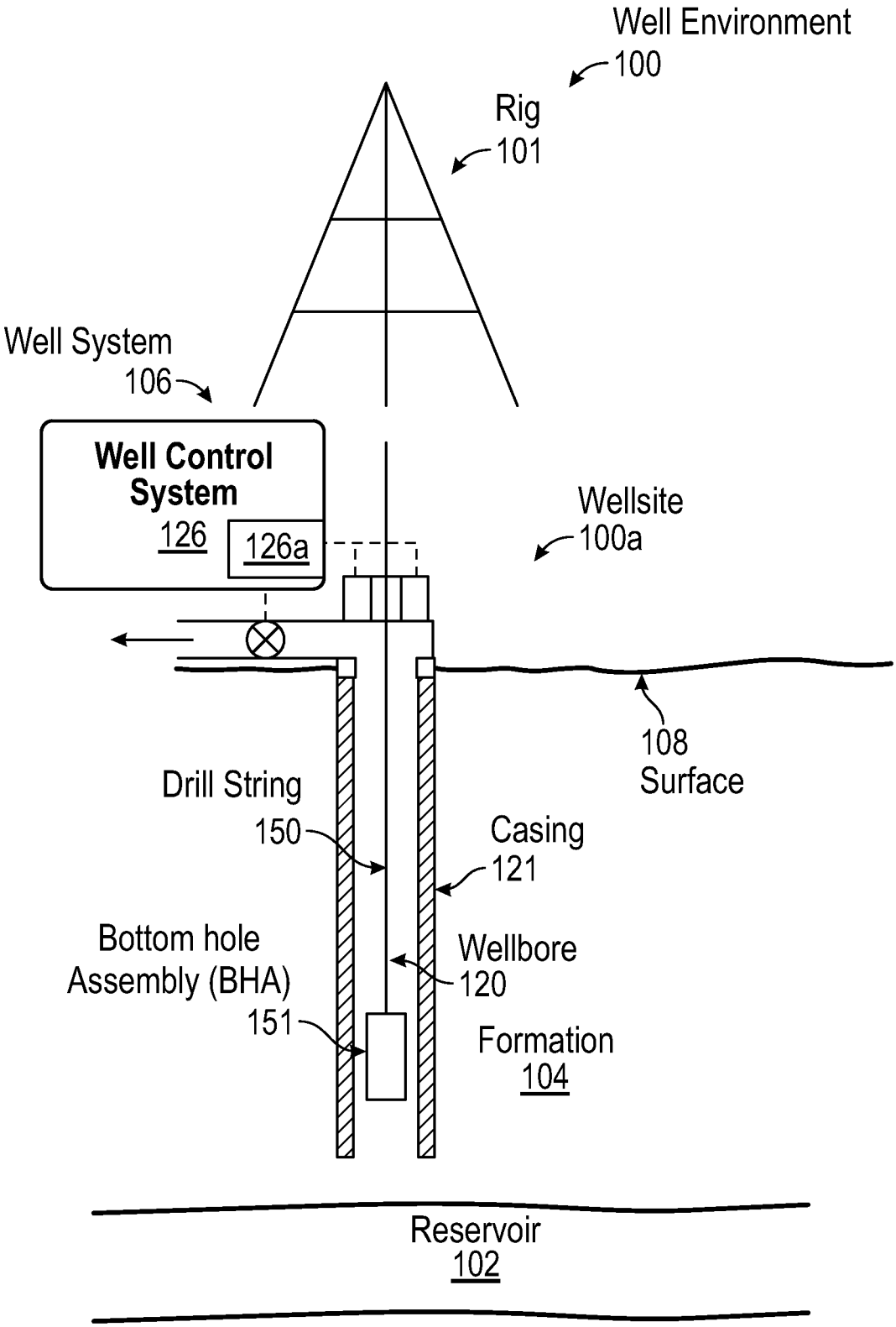
FIGS. 1A-1I show a system in accordance with one or more embodiments.

FIG. 1A shows a schematic diagram in accordance with one or more embodiments. As shown in FIG. 1A, a well environment (100) includes a subterranean formation ("formation") (104) and a well system (106). The formation (104) may include a porous or fractured rock formation that resides underground, beneath the Earth's surface ("surface") (108). The formation (104) may include different layers of rock having varying characteristics, such as varying degrees of permeability, porosity, capillary pressure, and resistivity. In the case of the well system (106) being a hydrocarbon well, the formation (104) may include a hydrocarbon-bearing reservoir (102). In the case of the well system (106) being operated as a production well, the well system (106) may facilitate the extraction of hydrocarbons (or "production") from the reservoir (102).

In some embodiments disclosed herein, the well system (106) includes a rig (101), a wellbore (120) with a casing (121), and a well control system (126) that are located at the wellsite (100*a*). The well control system (126) may control various operations of the well system (106), such as well logging operations, well production operations, well drilling operation, well completion operations, well maintenance operations, and reservoir monitoring, assessment and development operations. In one or more embodiments, these functionalities of the well control system (126) performed and/or facilitated using the method described in reference to FIG. 2 below.

The rig (101) is the machine used to drill a borehole to form the wellbore (120). Major components of the rig (101) include the drilling fluid tanks, the drilling fluid pumps (e.g., rig mixing pumps), the derrick or mast, the draw works, the rotary table or top drive, the drill string, the power generation equipment and auxiliary equipment. Drilling fluid, also referred to as "drilling mud" or simply "mud," is used to facilitate drilling boreholes into the earth, such as drilling oil and natural gas wells. The main functions of drilling fluids include providing hydrostatic pressure to prevent formation fluids from entering into the borehole, keeping the drill bit cool and clean during drilling, carrying out drill cuttings, and suspending the drill cuttings while drilling is paused and when the drilling assembly is brought in and out of the borehole.

The wellbore (120) includes a bored hole (i.e., borehole) that extends from the surface (108) towards a target zone of the formation (104), such as the reservoir (102). An upper end of the wellbore (120), terminating at or near the surface (108), may be referred to as the "up-hole" end of the wellbore (120), and a lower end of the wellbore, terminating in the formation (104), may be referred to as the "downhole" end of the wellbore (120). The wellbore (120) may facilitate the circulation of drilling fluids during drilling operations for the wellbore (120) to extend towards the target zone of the formation (104) (e.g., the reservoir (102)), facilitate the flow of hydrocarbon production (e.g., oil and gas) from the reservoir (102) to the surface (108) during production operations, facilitate the injection of substances (e.g., water) into the hydrocarbon-bearing formation (104) or the reservoir (102) during injection operations, or facilitate the communication of monitoring devices (e.g., logging tools) lowered into the formation (104) or the reservoir (102) during monitoring operations (e.g., during in situ logging operations).

In some embodiments, the well system (106) is provided with a bottom hole assembly (BHA) (151) attached to the drill string (150) to suspend into the wellbore (120) for performing the well drilling operation. The bottom hole assembly (BHA) is the lowest part of a drill string and includes the drill bit, drill collar, stabilizer, mud motor, etc. The BHA (151) is provided with one or more gyroscopes, magnetometers, accelerometers, and other types of sensors to perform MWD or LWD operations. The sensor data and/or signals are transmitted to the surface (108), e.g., the well control system (126) using fiber optics with laser light sources, or using other data transmission media such as electrical cables. In one or more embodiments, the fiber optics cable and/or electrical cable are routed in the hollow interior of the drill string (150) from the BHA to connect to a patch panel (126*a*) of the well control system (126). The patch panel (126*a*) is a passive device that organizes flexible connection of the data transmission cables to the hardware of the well control system (126). The data transmission cables may be disconnected and released from the patch panel (126*a*) in preparation to install an additional tubular/drill pipe to extend the existing drill string (150) at the wellsite (100*a*). The data transmission cables may then be re-routed through the installed tubular/drill pipe extension of the drill string (150) to be reconnected to the patch panel (126*a*).

Turning to FIGS. 1B-1I, FIGS. 1B-1I illustrate a portion of the drill string (150) depicted in FIG. 1A above. In one or more embodiments, one or more of the modules and/or elements shown in FIGS. 1B-1I may be omitted, repeated, combined and/or substituted. Accordingly, embodiments disclosed herein should not be considered limited to the specific arrangements of modules and/or elements shown in FIGS. 1B-1I.

Figure 1D:
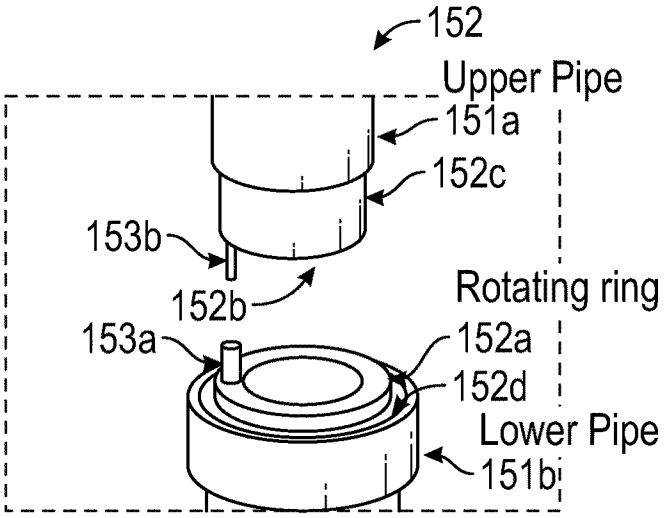
Figure 1E:
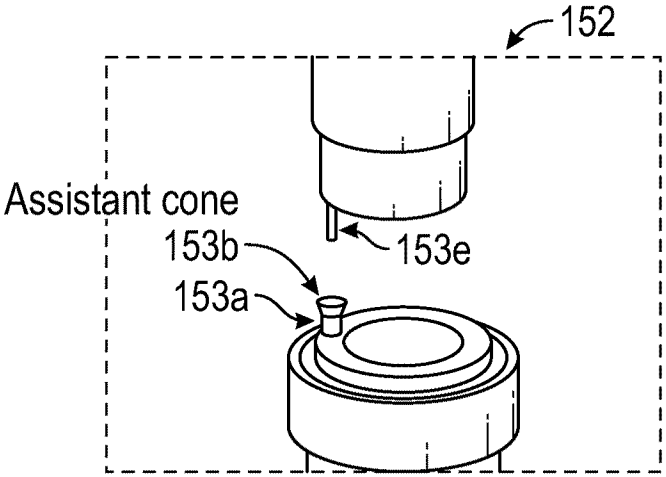
Figure 1C:
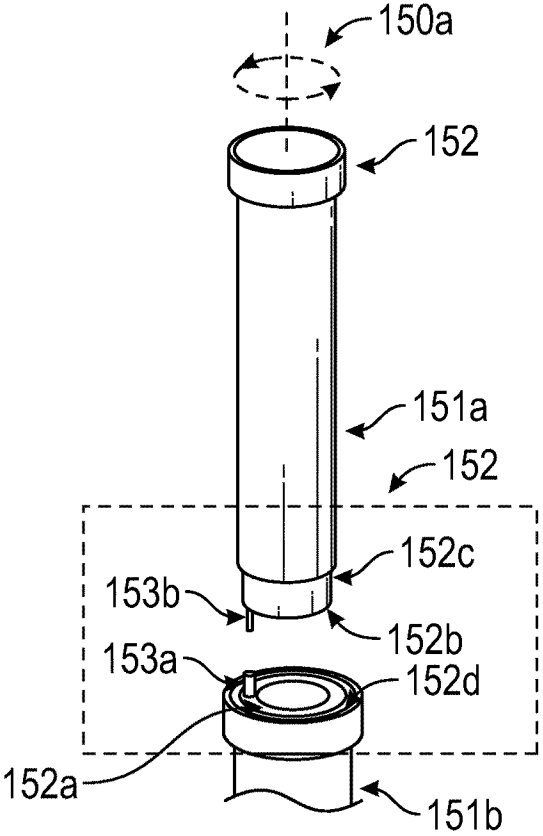
Figure 1B:
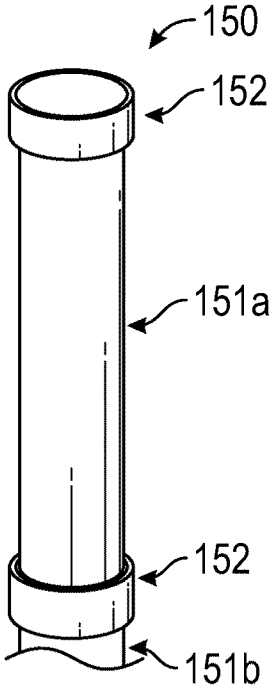

As shown in FIG. 1B, the drill string (150) includes multiple drill pipes (e.g., drill pipe A (151*a*), drill pipe B (151*b*)) that are connected to each other via respective joints, each referred to as a joint (152). For example, the drill pipe A (151*a*) and the drill pipe B (151*b*) are connected together at the wellsite (100*a*) before being lowered into the wellbore (120). In the context that the drill pipe A (151*a*) is disposed closer to the Earth's surface (108) than the drill pipe B (151*b*), the drill pipe A (151*a*) is referred to as the upper drill pipe to the drill pipe B (151*b*) or to the particular joint (152) between the drill pipe A (151*a*) and the drill pipe B (151*b*). In contrast, the drill pipe B (151*b*) is referred to as the lower drill pipe to the drill pipe A (151*a*) or to the particular joint (152) between the drill pipe A (151*a*) and the drill pipe B (151*b*). Each drill pipe is a hollow cylinder formed by a cylindrical wall having threaded fittings on either end of the drill pipe. Being a hollow cylinder, any cross section of the drill pipe has a ring shape defined by the cylindrical wall.

FIG. 1C illustrates the joint (152) for connecting the drill pipe A (151*a*) and the drill pipe B (151). The drill pipe A (151*a*) and the drill pipe B (151) are referred to as the upper drill pipe and the lower drill pipe, respectively, of the joint (152) between the drill pipe A (151*a*) and the drill pipe B (151). Throughout this disclosure, the terms "upper end," "upward," and "above" refer to the direction toward the surface (108) when the referred/described item is deployed in the wellbore (120). Correspondingly, the terms "lower end," "downward," "beneath," and "below" refer to the direction toward the downhole location when the referred/described item is deployed in the wellbore (120). As shown in FIG. 1C, the joint (152) is formed by mating a male thread fitting (152*c*) of the upper drill pipe and a female thread fitting (152*d*) of the lower drill pipe through a rotating motion (150*a*). The threads are on the outer wall surface of the male thread fitting (152*c*) and the inner wall surface of the female thread fitting (152*d*) that are not explicitly shown for clarity. The male thread fitting (152*c*) is at the lower end of the upper drill pipe where a stationary ring (152*b*) is placed. The joint (152) includes a rotating ring (152*a*) placed at the upper end of the lower drill pipe. When the male thread fitting (152*c*) is rotationally inserted into the female thread fitting (152*d*) to mate with the female thread fitting (152*d*), the stationary ring (152*b*) becomes connected with the rotating ring (152*a*) during the rotating motion (150*a*) of the male thread fitting (152*c*) and collectively advance downward as the mating is completed.

The joint (152) is configured to provide a mechanism for forming a continuous conduit along the entire length of the drill string (150) for routing data transmission cables. FIG. 1D shows an expanded view of the joint (152) to illustrate the mechanism. As shown in FIG. 1D, the stationary ring (152*b*) includes a hollow pin (153*b*) that protrudes downward along a longitudinal direction of the upper drill pipe. Correspondingly, the rotating ring (152*a*) includes a hollow pin (153*a*) that protrudes upward along a longitudinal direction of the lower drill pipe. To mate the male and female thread fittings, the upper and lower drill pipes are rotated with respect to each other to align the hollow pin (153*a*) and the hollow pin (153*b*). The hollow pin (153*b*) has a smaller diameter than that of the hollow pin (153*a*) and is inserted, upon being aligned, into the hollow pin (153*a*) to connect the stationary ring (152*b*) and the rotating ring (152*a*) as the male thread fitting (152*c*) is threaded into the female thread fitting (152*d*) to complete the joint (152). The rotating ring (152*a*) is free to rotate with respect to the cylindrical wall of the lower drill pipe. As the male thread fitting (152*c*) is rotationally inserted into the female thread fitting (152*d*), the rotating ring (152*a*) is guided by the hollow pin (153*a*) with the inserted hollow pin (153*b*) so as to rotate with the upper drill pipe during the rotating motion (150*a*) of mating the male thread fitting (152*c*) and the female thread fitting (152*d*). Upon completing the joint (152) with the male and female thread fittings tightly mated, the hollow pin (153*a*) and the hollow pin (153*b*) collectively form a connector that connects the interior portions of the upper and lower drill pipes. The hollow center of the connector allows interior cable routing between the upper and lower drill pipes. FIG.

1E shows a variation of the joint (152) where the hollow pin (153*a*) has a cone-shaped opening, referred to as the assistant cone (153*e*) that facilitates the insertion of the hollow pin (153*b*) into the hollow pin (153*a*). Although the hollow pin (153*b*) is shown as having the smaller diameter for inserting into the hollow pin (153*a*), in an alternative configuration the hollow pin (153*a*) may have the smaller diameter for inserting into the hollow pin (153*b*).

Figure 1F:
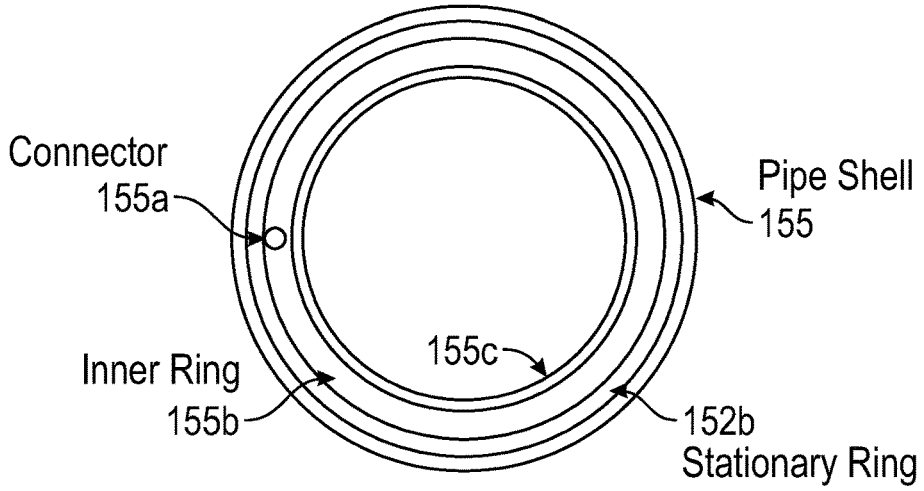

FIG. 1F shows a cross section view of the stationary ring (152*b*) fitted inside the pipe shell (155), i.e., the cylindrical wall of the upper drill pipe. As shown in FIG. 1F, the circular contour (155*c*) corresponds to the inside boundary of the stationary ring (152*b*). A free-rotating inner ring (155*b*) is contained within the stationary ring (152*b*). In particular, the inner ring (155*b*) is free to rotate independent of the stationary ring (152*b*) when the stationary ring (152*b*) rotates with the drill pipe to complete the threaded connection to the lower drill pipe. The inner ring (155*b*) has a hollow interior space that is used as a circular storage bin to store extra length of data transmission cables to facilitate connections and cable routing. Further, the inner ring (155*b*) includes a spring or other tension mechanism that functions as an automatic cable puller to pull in extra length of data transmission cable into the circular storage bin and provide proper tension to the routed cables.

Figure 1G:
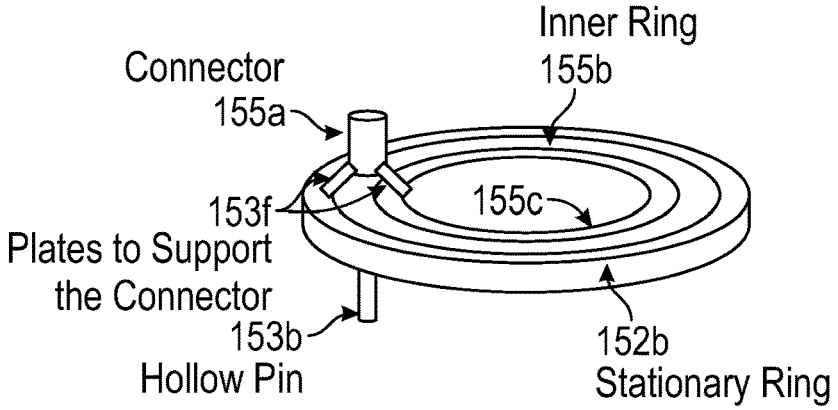

The stationary ring (152*b*) also contains a pin that work as the connector (155*a*). The connector (155*a*) is connected to the stationary ring (152*b*) and mechanically supported via plates (153*f*) as shown in FIG. 1G. The inner ring (155*b*) is able to rotate freely passing under the connector (155*a*). The connector (155*a*) corresponds to the hollow pin (153*b*) depicted in FIG. 1D.

Figure 1H:
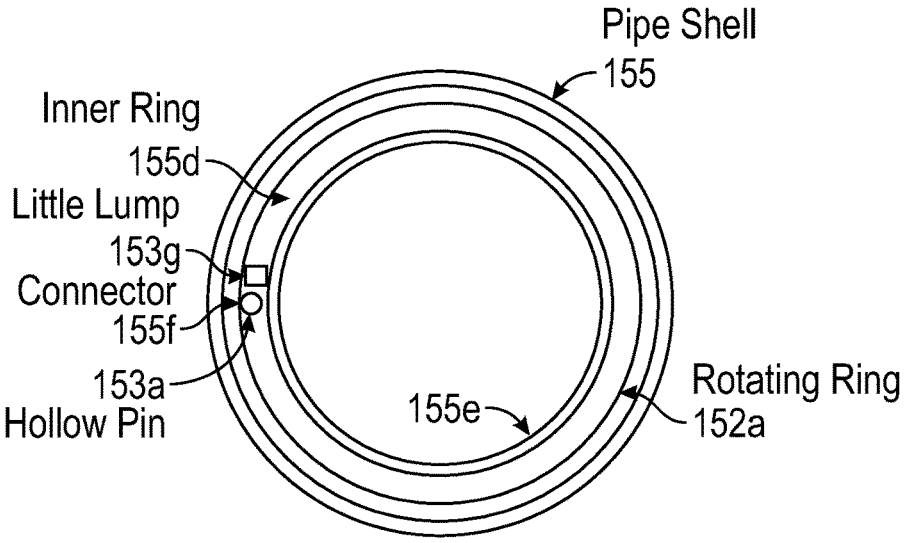

FIG. 1H shows a cross section view of the rotating ring (152*a*) fitted inside the pipe shell (155), i.e., the cylindrical wall of the lower drill pipe. As shown in FIG. 1H, the circular contour (155*e*) corresponds to the inside boundary of the rotating ring (152*a*). The rotating ring (152*a*) contains the connector (155*f*), corresponding to the hollow pin (153*a*) depicted in FIG. 1D, that fits in the upper connector (155*a*) of the stationary ring (152*b*) of the upper drill pipe. The rotating ring (152*a*) has the same design of the stationary ring (152*b*) except that the rotating ring (152*a*) can rotate downward with the rotating threading motion of the upper drill pipe due to the applied force exerted by the connection of the two connectors (155*a*, 155*f*). Additional support connection may be installed along the circular perimeter of the rotating ring (152*a*) if the connection of the two connectors (155*a*, 155*f*) alone is not sufficient to allow the rotating ring (152*a*) to rotate downward in a balanced manner. The other difference is that the rotating ring (152*a*) has a little lump (153*g*) installed before the fiber optic hole to prevent the fiber optic from slipping down.

Further as shown in FIG. 1H, the rotating ring (152*a*) also contains an inner ring (155*d*) for the same purpose of the inner ring (155*b*) on the stationary ring (152*b*). For example, the lump (153*g*) may be fixed on the inner ring (155*d*) while the connector (155*f*) is fixed on the rotating ring (152*a*). The inner ring (155*b*) and inner ring (155*d*) are free to rotate independently when the rotating ring (152*a*) is rotating together with the stationary ring (152*b*). Specifically, the inner ring (155*d*) has a hollow interior space that is used as a circular storage bin to store extra length of data transmission cables to facilitate connections and cable routing.

Figure 1I:
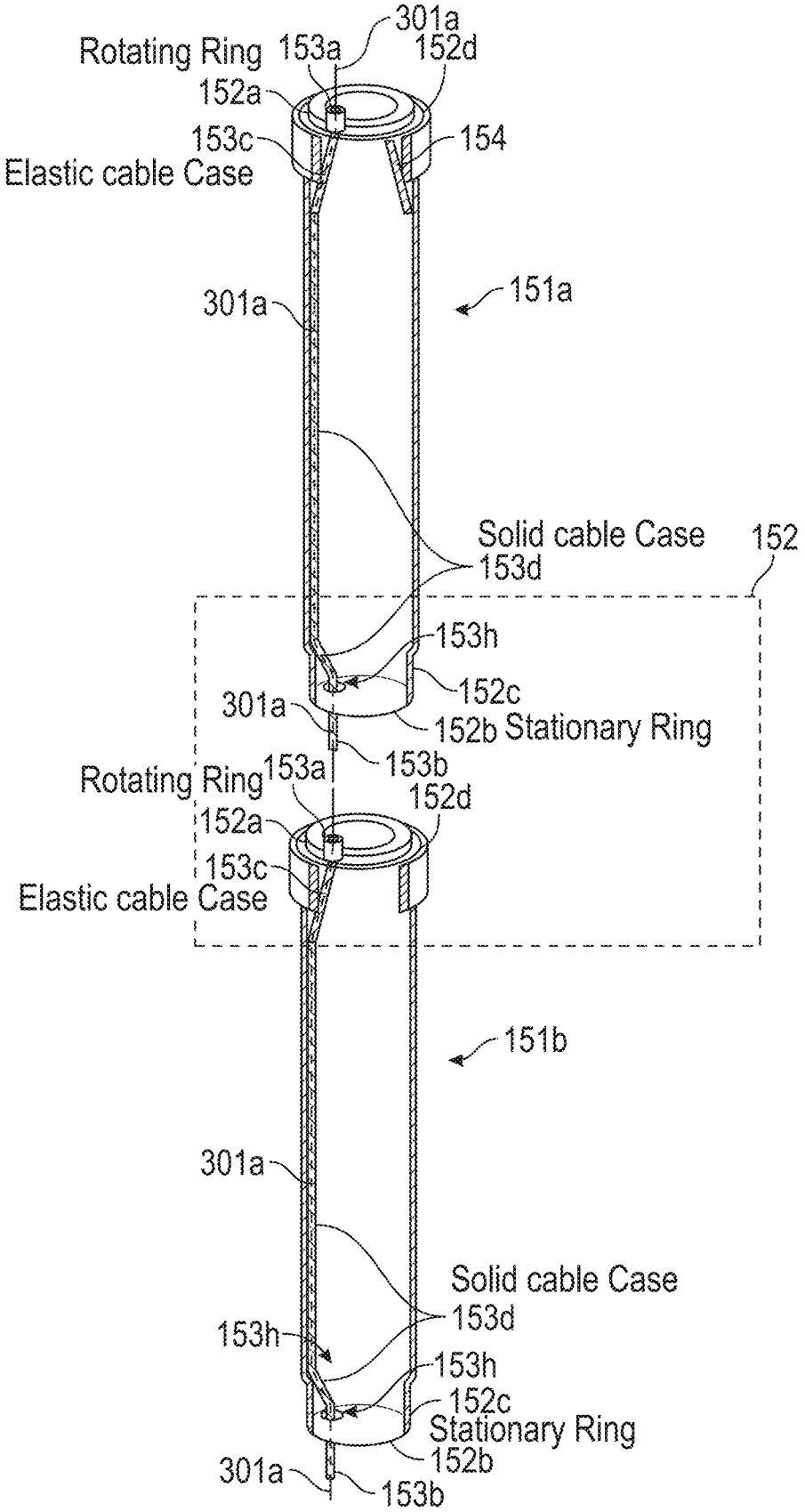

FIG. 1I shows a cutaway diagram of a joint (152) and the associated upper drill pipe (i.e., drill pipe A (151*a*)) and lower drill pipe (i.e., drill pipe B (151*b*)). As shown in FIG. 1I, each drill pipe is equipped with a solid cable case (153*d*) that runs along the inner wall of the drill pipe and contains pre-installed data transmission cables (301*a*). The solid cable case (153*d*) may be a rigid conduit that protects the pre-routed data transmission cables (301*a*). In addition, each drill pipe contains a small segment of elastic cable case (153*c*) that extends upward from the solid cable case (153*d*) and connects to the hollow pin (153*a*) of the rotating ring (152*a*). This elastic cable case (153*c*) is a compressible or otherwise deformable extension of the rigid conduit to accommodate the up and down motion of the rotating ring (152*a*) during mating of the male female thread fittings and to protect the pre-routed data transmission cables (301*a*). One or more additional elastic support (154) may be installed along the circular perimeter of the rotating ring (152*a*) if the elastic cable case (153*c*) alone is not sufficient to allow the rotating ring (152*a*) to rotate downward in a balanced manner. The lower end of the solid cable case (153*d*) bends away from the inner wall surface of the drill pipe and penetrates an opening (153*h*) through the stationary ring (152*b*) to form the hollow pin (153*b*). For example, the opening (153*h*) may be located on the inner ring (155*d*) depicted in FIG. 1H.

The hollow pins (153*a*, 153) may be available in different shapes based on the wellsite conditions and requirements. The hollow pins may be associated with an assistant cone, assistant magnet, or sponge material to facilitate the connection/splicing and to protect the optical fiber cables. The sponge material is to be attached to the end of each hollow pin to prevent cutting the optical fiber cable by the hollow pins during connection or splicing. The magnets are to be attached to the end of each hollow pin to facilitate aligning the hollow pins.

Upon completing the mating of the male and female thread fittings of the joint (152), the solid cable cases (153*d*) of the upper and lower drill pipes are connected to each other via the intervening elastic cable case (153*c*) and hollow pins (153*a*, 153*b*) to form a contiguous data transmission cable conduit along the inner wall surface of the connected upper and lower drill pipes. As a long sequence of drill pipes are connected to form the drill string (150), the solid cable cases (153*d*) throughout the entire connected sequence of drill pipes are sequentially connected to each other via intervening elastic cable cases (153*c*) and hollow pins (153*a*, 153*b*) to form a long contiguous data transmission cable conduit along the inner wall of the entire drill string (150) from the BHA (151) to the top of the drill string (150) at the surface (108).

Although the well system described above relate to connecting drill pipes in a drilling operation at the wellsite, this disclosure may be extended to connecting other wellbore tubulars during pre-drilling and post-drilling operations, collectively referred to as wellbore operations including drilling operation, production operation, fracking operation, injection and reservoir monitoring operation, etc. In other words, the drill string and drill pipe described in this disclosure may be extended to more general terms "wellbore string" and "wellbore tubular." For example, the wellbore string may include drill string, production string, etc.

Figure 2:
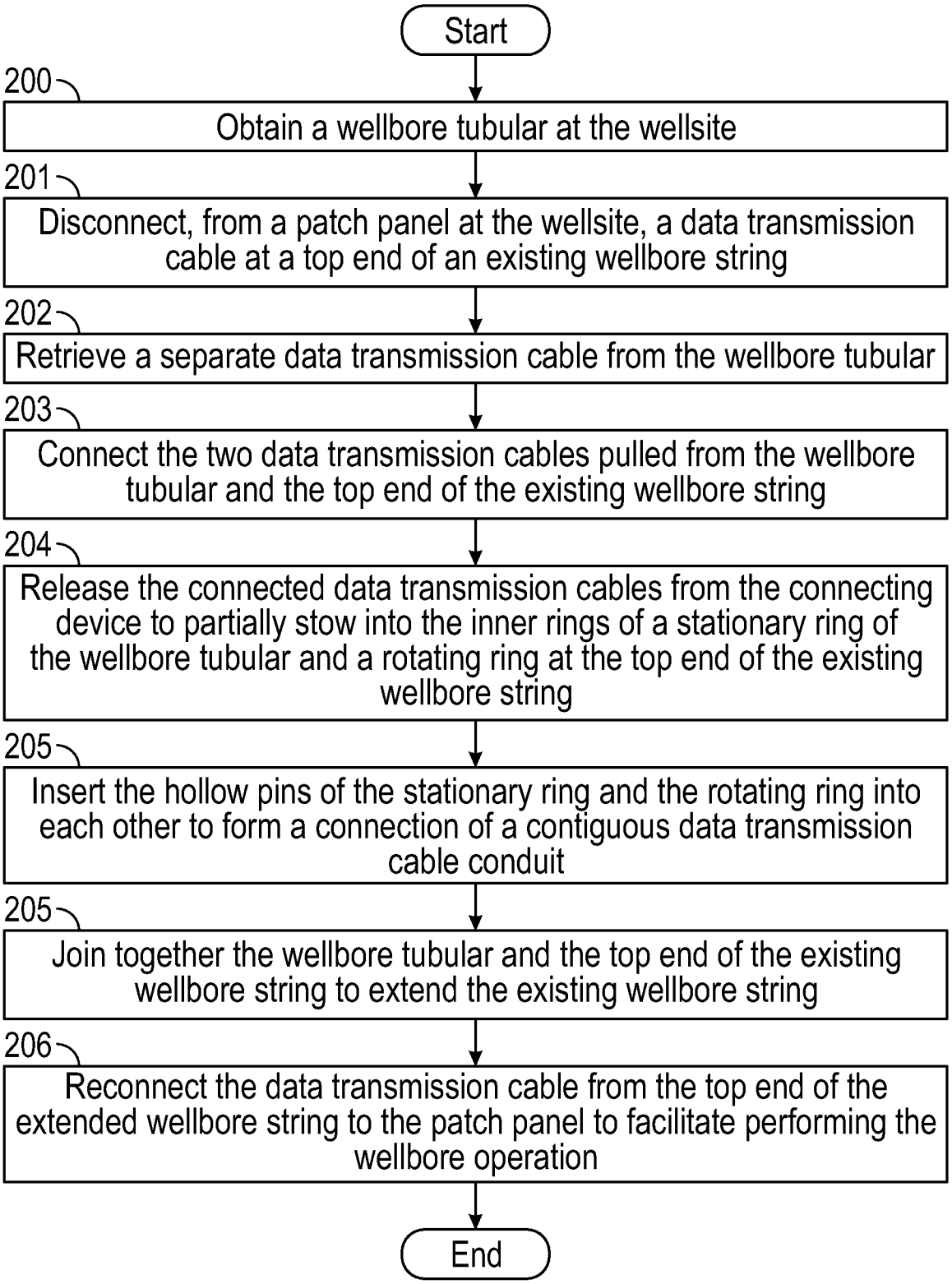
FIG. 2 shows a flowchart in accordance with one or more embodiments.

Turning to FIG. 2, FIG. 2 shows a process flowchart in accordance with one or more embodiments. Specifically, FIG. 2 describes a method of connecting wellbore tubulars to establish a contiguous conduit for routing a data transmission cable from a downhole location to the surface. One or more blocks in FIG. 2 may be performed using one or more components as described in FIGS. 1A-1I. While the various blocks in FIG. 2 are presented and described sequentially, one of ordinary skill in the art will appreciate that some or all of the blocks may be executed in a different order, may be combined or omitted, and some or all of the blocks may be executed in parallel and/or iteratively. Furthermore, the blocks may be performed actively or passively.

In one or more embodiments, fiber optics and laser light sources are utilized for transmitting data between the downhole location (e.g., drilling bit) and the surface end points. The wellbore tubular connection method described herein facilitates the wellsite operator to splice the data transmission cable (e.g., optical fiber cable) and ensure a correct connection. Specifically, a data transmission cable is routed through a contiguous conduit inside the existing wellbore string from the downhole location to connect to a patch panel at the surface. The existing wellbore string is suspended in a wellbore with the top end of the wellbore string exposed and accessible by the wellsite operator. The wellbore tubular connection method allows an additional wellbore tubular to be added to the top end of the existing wellbore string at the same time to extend the contiguous conduit and the data transmission cable through the added wellbore tubular.

Initially in Block 200, a wellbore tubular, in addition to and separate from an existing wellbore string, is obtained at the wellsite to extend the existing wellbore string. For example, the wellbore tubular may be the drill string described above or a different type of tubular having similar construction as the drill string described above.

Figure 3A:
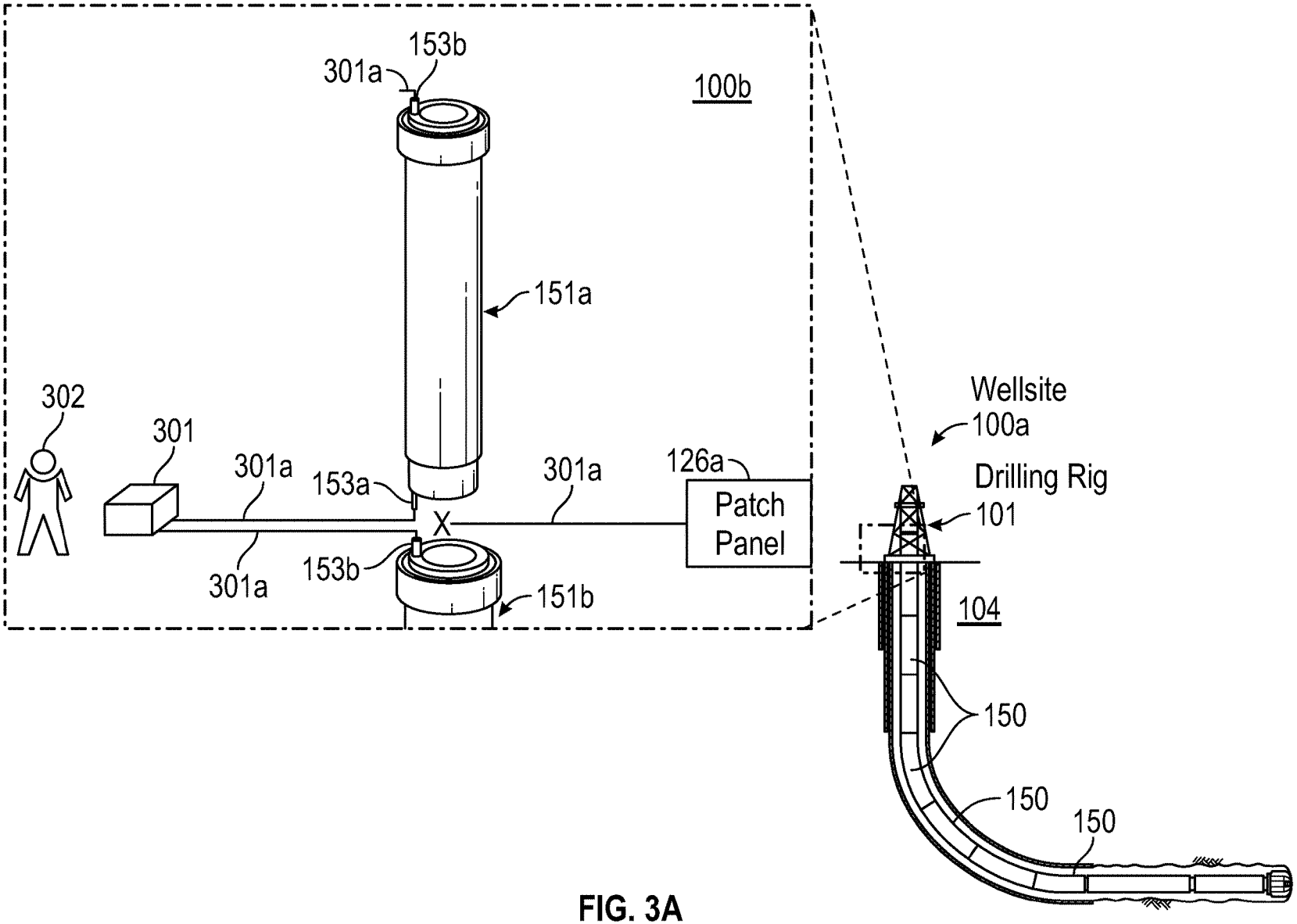
FIGS. 3A-3F show an example in accordance with one or more embodiments.

In Block 201, the data transmission cable at the top end of the existing wellbore string is disconnected from the patch panel at the wellsite. An example is shown in FIG. 3A where the data transmission cable (301*a*) is disconnected (denoted as the X mark) between the patch panel (126*a*) and the wellbore tubular (e.g., drill pipe B (151*b*)) at the top end of the existing wellbore string (e.g., drill string (150)). The disconnection may be performed by, or under the control of the wellsite operator (302). As shown in FIG. 3A, the patch panel (126*a*) is located at the wellsite (100*a*) depicted in FIG. 1A above. FIG. 3A is not drawn to scale so as to expand a portion (100*b*) of the wellsite (100*a*) to illustrate relevant details.

In Block 202, the data transmission cables are retrieved (e.g., pulled) from the additional wellbore tubular and the top end of the existing wellbore string. As shown in FIG. 3A, the data transmission cables (301*a*) are pulled from respective hollow pins (153*a*, 153*b*) of the wellbore string (e.g., drill pipe B (151*b*)) and the additional wellbore (e.g., drill pipe A (151*a*)). The cable pulling may be performed by, or under the control of the wellsite operator (302).

As described in reference to FIGS. 1F-1I, before the installation of the additional wellbore (e.g., drill pipe A (151*a*)), the data transmission cable routed inside the wellbore is spliced to the additional data transmission cable stored inside the inner ring. The data transmission cable stored in the inner ring is extended to the connector or hollow pin of the inner ring but not exposed so as to be protected inside the inner ring. A lead wire or rope extends from the data transmission cable and through the connector or hollow pin to be accessible by the wellsite operator. Accordingly, the wellsite operator pulls on the lead wire/rope to pull out the data transmission cable for connecting to the connecting device. The inner ring in the upper drill pipe is exerting a force to pull the data transmission cable upward. This force may be created through springs or elastic belts. As the upper drill pipe is lowered and connected to the lower drill pipe, the inner ring starts to pull the data transmission cable upward to prevent from twisting. As the two hollow pins touch each other, the function of the inner ring ends and return to the rest position.

Figure 3D:
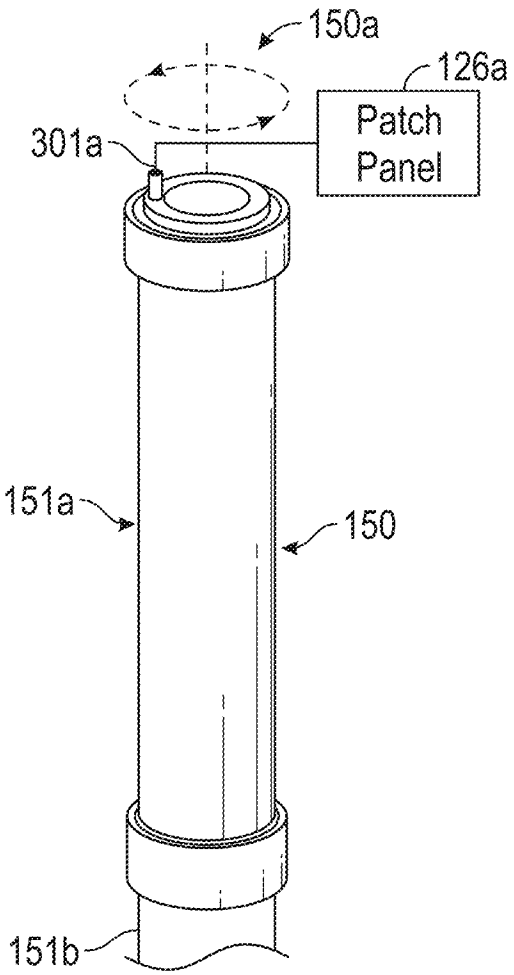
Figure 3C:
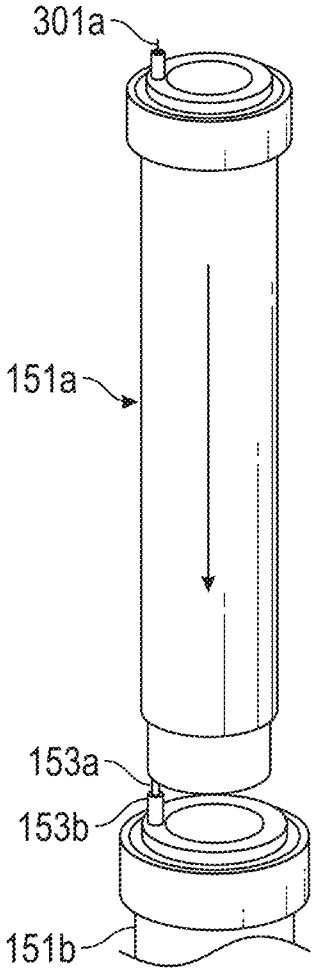

In Block 203, the data transmission cables pulled from the additional wellbore tubular and the top end of the existing wellbore string are connected or spliced together. As shown in FIG. 3A, the data transmission cables (301*a*) pulled from the hollow pins (153*a*, 153*b*) are connected via an extender (e.g., connecting device (301) depicted in FIG. 3E) or spliced via a splicing device (e.g., connecting device (301) depicted in FIG. 3F). The cable connection/splicing may be performed by, or under the control of the wellsite operator (302).

Figure 3B:
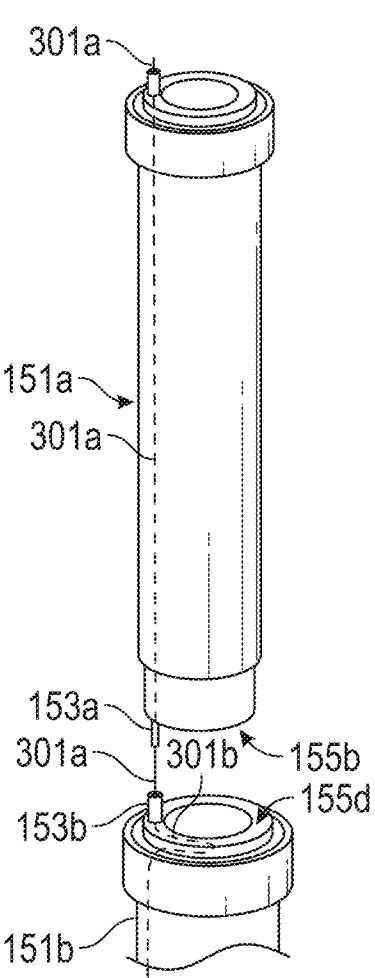
Figure 3E:
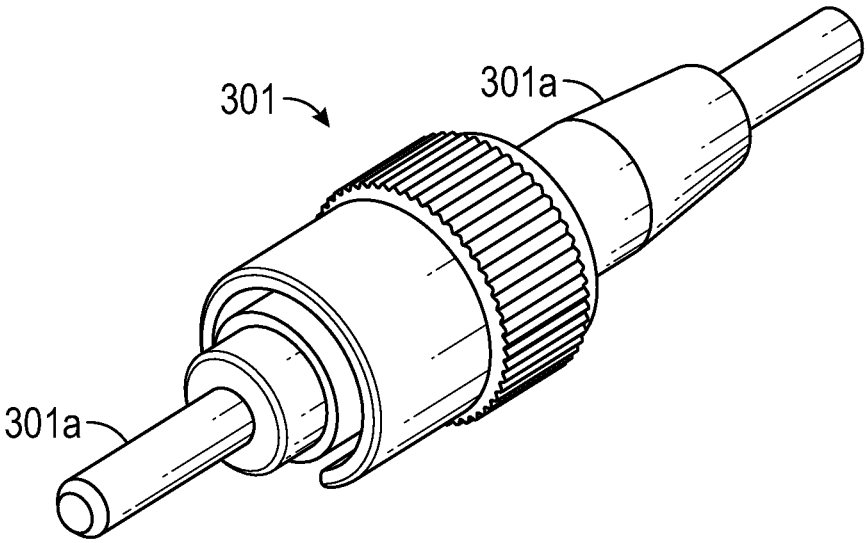
Figure 3F:
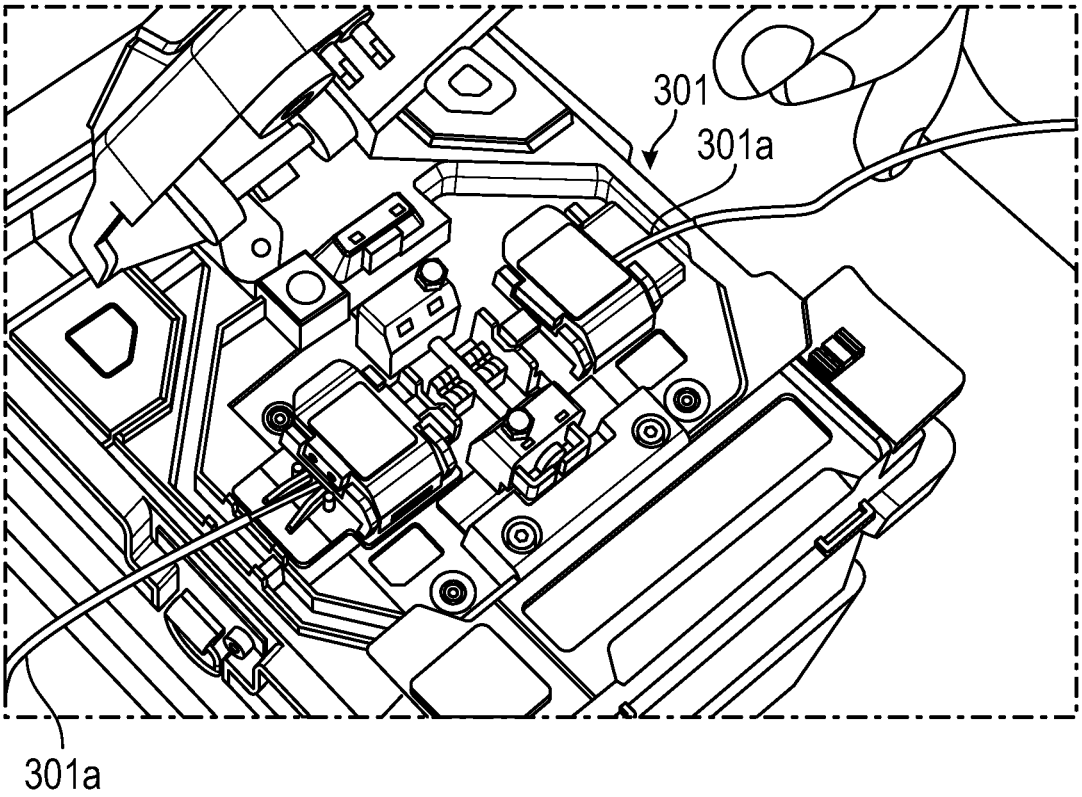

In Block 204, the connected/spliced data transmission cable are released from the extender/splicing device and automatically pulled into the inner ring of each of the stationary ring and rotating ring of the additional wellbore tubular and the existing wellbore string. An example is shown in FIG. 3B where extra length (301*b*) of the connected/spliced data transmission cable (301*a*) are pulled into the inner rings (155*b*, 155*d*) such that the data transmission cable (301*a*) is straight with proper tension between the two hollow pins (153*a*, 153*b*). For example, the inner ring may be provided with a spring or other tension mechanism that pulls the extra length fiber cable (301*b*) into the inner ring.

In Block 205, the hollow pins of the stationary and rotating rings are inserted into each other to form a connection of the data transmission cable conduit. An example is shown in FIG. 3C where the additional wellbore tubular (e.g., drill pipe A (151*a*)) is lowered toward the existing wellbore string (e.g., drill pipe B (151*b*)) at the top end of the existing wellbore string to insert the hollow pins (153*a*, 153*b*). The continuity of the data transmission cable (301*a*) through the connected hollow pins (153*a*, 153*b*) is verified, e.g., by evaluating a test signal transmitted from the downhole sensor to the surface. The connection and continuity verification of the hollow pins (153*a*, 153*b*) may be performed by, or under the control of the wellsite operator (302).

In Block 205, the additional wellbore tubular and the wellbore tubular at the top end of the existing wellbore string are joined together to extend the existing wellbore string by mating the respective male and female thread fittings. An example is shown in FIG. 3D, the additional wellbore tubular (e.g., drill pipe A (151*a*)) and the installed wellbore tubular (e.g., drill pipe B (151*b*)) at the top end of the existing wellbore string are joined together where the rotating ring of the installed wellbore tubular (e.g., the drill pipe B (151*b*)) rotates downward. The rotating ring at the top end of the installed wellbore tubular is pushed downward further into the installed wellbore tubular by the downward threading motion of the additional wellbore tubular. The downward movement of the rotating ring further into the installed wellbore tubular is accommodated by the elastic cable case and other elastic support(s) beneath the rotating ring. At the same time, the rotating ring of the installed wellbore tubular is guided by the connection of the two hollow pins to rotate with the rotating threading motion of the additional well tubular (e.g., the drill pipe A (151*a*)).

In Block 206, the data transmission cable from the top end of the extended wellbore string is reconnected to the patch panel to facilitate performing the drilling operation, such as MWD. As shown in FIG. 3D, once the additional wellbore tubular (e.g., drill pipe A (151*a*)) is connected to extend the existing wellbore string (e.g., drill string (150)), the data transmission cable (301*a*) from the top end of the extended wellbore string (150) is connected to the patch panel (126*a*).

As noted above, this disclosure may be extended to connecting wellbore tubulars during pre-drilling, drilling, and post-drilling operations, collectively referred to as wellbore operations including drilling operation, production operation, fracking operation, injection and reservoir monitoring operation, etc. In other words, the drill string and drill pipe described in this disclosure may be extended to more general terms "wellbore string" and "wellbore tubular." For example, the wellbore string may include drill string, production string, etc. The extended system and method may facilitate various applications such as (i) optimized selection for downhole sampling operations including the zone and sample quality, (ii) optimized zonal selection for cutting/perforation, (iii) advanced well placement, (iv) fluid subsurface plume monitoring including CO2, H2, H2O, and (v) real-time kick detection.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A wellbore tubular for performing a wellbore operation in a subterranean formation, comprising:

a hollow cylinder formed by a cylindrical wall having a male thread fitting and a female thread fitting at a lower end and an upper end, respectively, of the cylindrical wall;

a first stationary ring disposed at the lower end of the cylindrical wall and having a first lower end hollow pin protruding downward from the first stationary ring;

a first rotating ring disposed at the upper end of the cylindrical wall and having a first upper end hollow pin protruding upward from the first rotating ring;

a first rigid conduit disposed inside the hollow cylinder and extending from the first lower end hollow pin to beneath the first rotating ring;

a first elastic conduit disposed inside the hollow cylinder to extend the first rigid conduit from beneath the first rotating ring to the first upper end hollow pin; and a first data transmission cable routed from the first lower end hollow pin to the first upper end hollow pin through the first rigid conduit and the first elastic conduit, wherein the wellbore tubular is adapted to connect to a lower wellbore tubular using the male thread fitting to collectively form a portion of a wellbore string, wherein the first lower end hollow pin is adapted to connect with a second upper end hollow pin of the lower wellbore tubular prior to a first rotating threading motion of the wellbore tubular to connect to the lower wellbore tubular, wherein the first stationary ring is adapted to connect and rotate with a second rotating ring of the lower wellbore tubular during the first rotating threading motion of the wellbore tubular, and wherein connecting the second upper end hollow pin of the lower wellbore tubular and the first lower end hollow pin allows the first rigid conduit and the first elastic conduit to connect to a second rigid conduit and a second elastic conduit inside the lower wellbore tubular to form a portion of a contiguous data transmission cable conduit from a downhole location to the Earth's surface.

2. The wellbore tubular of claim 1, wherein connecting the second upper end hollow pin of the lower wellbore tubular and the first lower end hollow pin further allows the first data transmission cable to connect to a second data transmission cable routed through the second rigid conduit and the second elastic conduit inside the lower wellbore tubular to form a portion of a contiguous data transmission cable from the downhole location to the Earth's surface.

3. The wellbore tubular of claim 1, wherein the first stationary ring comprises a first rotatable inner ring, and wherein the first rotatable inner ring comprises a first hollow interior space adapted to store a first extra length of the first data transmission cable.

4. The wellbore tubular of claim 2, wherein the second rotating ring comprises a second rotatable inner ring, and wherein the second rotatable inner ring comprises a second hollow interior space adapted to store a second extra length of the second data transmission cable.

5. The wellbore tubular of claim 1, wherein the first data transmission cable comprises an optical fiber cable.

6. The wellbore tubular of claim 2, wherein the wellbore tubular is further adapted to connect to an upper wellbore tubular using the female thread fitting to further collectively form the portion of the wellbore string, wherein the first upper end hollow pin is adapted to connect with a second lower end hollow pin of the upper wellbore tubular prior to a second rotating threading motion of the upper wellbore tubular to connect to the wellbore tubular, wherein the first rotating ring is adapted to connect and rotate with a second stationary ring of the upper wellbore tubular during the second rotating threading motion of the upper wellbore tubular, wherein connecting the second lower end hollow pin of the upper wellbore tubular and the first upper end hollow pin allows the first rigid conduit and the first elastic conduit to connect to a third rigid conduit and a third elastic conduit inside the upper wellbore tubular to further form the portion of the contiguous data transmission cable conduit from the downhole location to the Earth's surface and wherein connecting the second lower end hollow pin of the upper wellbore tubular and the first upper end hollow pin allows the first data transmission cable to connect to a third data transmission cable routed through the third rigid conduit and the third elastic conduit inside the upper wellbore tubular to further form the portion of the contiguous data transmission cable from the downhole location to the Earth's surface.

7. The wellbore tubular of claim 6, wherein the first elastic conduit is adapted to allow the first rotating ring to rotate downward further into the hollow cylinder during the second rotating threading motion of the upper wellbore tubular.

8. A wellbore string for drilling a subterranean formation, comprising:

a wellbore tubular comprising:

a hollow cylinder formed by a cylindrical wall having a male thread fitting and a female thread fitting at a lower end and an upper end, respectively, of the cylindrical wall;

a first stationary ring disposed at the lower end of the cylindrical wall and having a first lower end hollow pin protruding downward from the first stationary ring;

a first rotating ring disposed at the upper end of the cylindrical wall and having a first upper end hollow pin protruding upward from the first rotating ring;

a first rigid conduit disposed inside the hollow cylinder and extending from the first lower end hollow pin to beneath the first rotating ring;

a first elastic conduit disposed inside the hollow cylinder to extend the first rigid conduit from beneath the first rotating ring to the first upper end hollow pin; and a first data transmission cable routed from the first lower end hollow pin to the first upper end hollow pin through the first rigid conduit and the first elastic conduit; and a lower wellbore tubular;

wherein the wellbore tubular is adapted to connect to the lower wellbore tubular using the male thread fitting to collectively form a portion of the wellbore string, wherein the first lower end hollow pin is adapted to connect with a second upper end hollow pin of the lower wellbore tubular prior to a first rotating threading motion of the wellbore tubular to connect to the lower wellbore tubular, wherein the first stationary ring is adapted to connect and rotate with a second rotating ring of the lower wellbore tubular during the first rotating threading motion of the wellbore tubular, and wherein connecting the second upper end hollow pin of the lower wellbore tubular and the first lower end hollow pin allows the first rigid conduit and the first elastic conduit to connect to a second rigid conduit and a second elastic conduit inside the lower wellbore tubular to form a portion of a contiguous data transmission cable conduit from a downhole location to the Earth's surface.

9. The wellbore string of claim 8, wherein connecting the second upper end hollow pin of the lower wellbore tubular and the first lower end hollow pin further allows the first data transmission cable to connect to a second data transmission cable routed through the second rigid conduit and the second elastic conduit inside the lower wellbore tubular to form a portion of a contiguous data transmission cable from the downhole location to the Earth's surface.

10. The wellbore string of claim 8, wherein the first stationary ring comprises a first rotatable inner ring, and wherein the first rotatable inner ring comprises a first hollow interior space adapted to store a first extra length of the first data transmission cable.

11. The wellbore string of claim 8, wherein the second rotating ring comprises a second rotatable inner ring, and wherein the second rotatable inner ring comprises a second hollow interior space adapted to store a second extra length of the second data transmission cable.

12. The wellbore string of claim 8, wherein the first data transmission cable comprises an optical fiber cable.

13. The wellbore string of claim 8, further comprising:

an upper wellbore tubular, wherein the wellbore tubular is further adapted to connect to the upper wellbore tubular using the female thread fitting to further collectively form the portion of the wellbore string, wherein the first upper end hollow pin is adapted to connect with a second lower end hollow pin of the upper wellbore tubular prior to a second rotating threading motion of the upper wellbore tubular to connect to the wellbore tubular, wherein the first rotating ring is adapted to connect and rotate with a second stationary ring of the upper wellbore tubular during the second rotating threading motion of the upper wellbore tubular, wherein connecting the second lower end hollow pin of the upper wellbore tubular and the first upper end hollow pin allows the first rigid conduit and the first elastic conduit to connect to a third rigid conduit and a third elastic conduit inside the upper wellbore tubular to further form the portion of the contiguous data transmission cable conduit from the downhole location to the Earth's surface and wherein connecting the second lower end hollow pin of the upper wellbore tubular and the first upper end hollow pin allows the first data transmission cable to connect to a third data transmission cable routed through the third rigid conduit and the third elastic conduit inside the upper wellbore tubular to further form the portion of the contiguous data transmission cable from the downhole location to the Earth's surface.

14. The wellbore string of claim 13, wherein the first elastic conduit is adapted to allow the first rotating ring to rotate downward further into the hollow cylinder during the second rotating threading motion of the upper wellbore tubular.

15. A method for performing a wellbore operation at a wellsite of a subterranean formation, comprising:

obtaining a wellbore tubular at the wellsite, the wellbore tubular comprising:

a hollow cylinder formed by a cylindrical wall having a male thread fitting and a female thread fitting at a lower end and an upper end, respectively, of the cylindrical wall;

a first stationary ring disposed at the lower end of the cylindrical wall and having a first lower end hollow pin protruding downward from the first stationary ring, the first stationary ring comprising a first rotatable inner ring, the first rotatable inner ring comprising a first hollow interior space adapted to store a first extra length of a first data transmission cable;

wherein the wellbore tubular is adapted to connect, using the male thread fitting, to a lower wellbore tubular at a top end of a wellbore string to extend the wellbore string, the wellbore string comprising a second data transmission cable;

disconnecting, from a patch panel at the wellsite, an upper terminal of the second data transmission cable at a top end of the wellbore string;

retrieving, from the wellbore tubular through the first lower end hollow pin, a lower terminal of the first data transmission cable;

connecting, using a connecting device, the lower terminal of the first data transmission cable and the upper terminal of the second data transmission cable to form a portion of a contiguous data transmission cable;

releasing, from the connecting device, the first data transmission cable and the second data transmission cable to stow the first extra length of the first data transmission cable into at least the first rotatable inner ring;

inserting the first lower end hollow pin of the first stationary ring and a second upper end hollow pin of a second rotating ring of the lower wellbore tubular into each other to form a portion of a contiguous data transmission cable conduit;

joining, by a first rotating threading motion of the wellbore tubular, the wellbore tubular and the lower wellbore tubular together at the top end of the wellbore string to extend the wellbore string; and reconnecting, through a first upper end hollow pin of the wellbore tubular, an upper terminal of the first data transmission cable to the patch panel to facilitate performing the wellbore operation.

16. The method of claim 15, further comprising:

stowing, in response to releasing the first data transmission cable and the second data transmission cable from the connecting device, a second extra length of the second data transmission cable into at least a second rotatable inner ring of the second rotating ring.

17. The method of claim 15, wherein the wellbore tubular further comprising:

a first rotating ring disposed at the upper end of the cylindrical wall and having a first upper end hollow pin protruding upward from the first rotating ring;

a first rigid conduit disposed inside the hollow cylinder and extending from the first lower end hollow pin to beneath the first rotating ring;

a first elastic conduit disposed inside the hollow cylinder to extend the first rigid conduit from beneath the first rotating ring to the first upper end hollow pin; and the first data transmission cable routed from the first lower end hollow pin to the first upper end hollow pin through the first rigid conduit and the first elastic conduit, wherein the first lower end hollow pin is adapted to connect with a second upper end hollow pin of the lower wellbore tubular prior to the first rotating threading motion of the wellbore tubular to connect to the lower wellbore tubular, wherein the first stationary ring is adapted to connect and rotate with the second rotating ring of the lower wellbore tubular during the first rotating threading motion of the wellbore tubular, wherein connecting the second upper end hollow pin of the lower wellbore tubular and the first lower end hollow pin allows the first rigid conduit and the first elastic conduit to connect to a second rigid conduit and a second elastic conduit inside the lower wellbore tubular to form the portion of the contiguous data transmission cable conduit from a downhole location to the Earth's surface, wherein connecting the second upper end hollow pin of the lower wellbore tubular and the first lower end hollow pin further allows the first data transmission cable to connect to the second data transmission cable routed through the second rigid conduit and the second elastic conduit inside the lower wellbore tubular to form a portion of a contiguous data transmission cable from the downhole location to the Earth's surface, and wherein the data transmission cable comprises an optical fiber cable.

18. The method of claim 15, further comprising:

obtaining an upper wellbore tubular at the wellsite; and connecting, using the female thread fitting, the wellbore tubular to the upper wellbore tubular to further collectively form the portion of the wellbore string, wherein the first upper end hollow pin is adapted to connect with a second lower end hollow pin of the upper wellbore tubular prior to a second rotating threading motion of the upper wellbore tubular to connect to the wellbore tubular, wherein the first rotating ring is adapted to connect and rotate with a second stationary ring of the upper wellbore tubular during the second rotating threading motion of the upper wellbore tubular, and wherein connecting the second lower end hollow pin of the upper wellbore tubular and the first upper end hollow pin allows the first rigid conduit and the first elastic conduit to connect to a third rigid conduit and a third elastic conduit inside the upper wellbore tubular to further form the portion of the contiguous data transmission cable conduit from the downhole location to the Earth's surface.

19. The method of claim 18, wherein connecting the second lower end hollow pin of the upper wellbore tubular and the first upper end hollow pin further allows the first data transmission cable to connect to a third data transmission cable routed through the third rigid conduit and the third elastic conduit inside the upper wellbore tubular to further form the portion of the contiguous data transmission cable from the downhole location to the Earth's surface.

20. The method of claim 18, wherein the first elastic conduit is adapted to allow the first rotating ring to rotate downward further into the hollow cylinder during the second rotating threading motion of the upper wellbore tubular.

* * * * *